US008612102B2

(12) United States Patent
Ohhigashi et al.

(10) Patent No.: US 8,612,102 B2
(45) Date of Patent: Dec. 17, 2013

(54) HYDRAULIC EXCAVATOR AND HYDRAULIC EXCAVATOR CONTROL METHOD

(75) Inventors: Kouji Ohhigashi, Duesseldorf (DE); Mitsuhiko Kamado, Hirakata (JP); Takao Suehiro, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/393,307

(22) PCT Filed: May 17, 2011

(86) PCT No.: PCT/JP2011/061287

§ 371 (c)(1),
(2), (4) Date: Mar. 28, 2012

(87) PCT Pub. No.: WO2011/145600

PCT Pub. Date: Nov. 24, 2011

(65) Prior Publication Data

US 2012/0177470 A1 Jul. 12, 2012

(30) Foreign Application Priority Data

May 17, 2010 (JP) ..... 2010-113346
Nov. 19, 2010 (JP) ..... 2010-259219

(51) Int. Cl.
*F01B 1/00* (2006.01)

(52) U.S. Cl.
USPC ..... 701/50; 414/687; 701/54; 701/84; 701/101

(58) Field of Classification Search
USPC ..... 701/50
See application file for complete search history.

(56) References Cited

U.S. PATENT DOCUMENTS

| | | | | |
|---|---|---|---|---|
| 6,637,530 | B1 * | 10/2003 | Endo et al. | 180/65.25 |
| 7,143,859 | B2 * | 12/2006 | Ohtsukasa | 180/307 |
| 7,373,239 | B2 * | 5/2008 | Kamado et al. | 701/103 |
| 8,087,240 | B2 * | 1/2012 | Morinaga et al. | 60/414 |
| 2009/0301075 | A1 | 12/2009 | Morinaga et al. | |
| 2009/0320461 | A1 * | 12/2009 | Morinaga et al. | 60/431 |

FOREIGN PATENT DOCUMENTS

| | | | |
|---|---|---|---|
| JP | 2004-100621 | A | 4/2004 |
| WO | WO-2007/052538 | A1 | 5/2007 |
| WO | WO-2009/157511 | A1 | 12/2009 |

OTHER PUBLICATIONS

International Search Report of corresponding PCT Application No. PCT/JP2010/061287.

* cited by examiner

*Primary Examiner* — Helal A Algahaim
*Assistant Examiner* — Rebeca Wagner
(74) *Attorney, Agent, or Firm* — Global IP Counselors, LLP

(57) ABSTRACT

In a hydraulic excavator, a controller is configured to control output of an engine based on a first engine output torque line that defines an upper limit for engine output torque against engine rotation rate. The controller is configured to determine which of two operations, a high hydraulic load operation in which a work machine is subjected to a high hydraulic load and a low hydraulic load operation in which the work machine is subjected to a low hydraulic load, is being performed. When swinging for a revolving unit and the low hydraulic load operation for the work machine are being performed as a combined operation, the controller is configured to control the output of the engine based on a second engine output torque line. The second engine output torque line is an engine output torque line with a lower engine output torque than the first engine output torque line.

7 Claims, 5 Drawing Sheets

HYDRAULIC EXCAVATOR AND HYDRAULIC EXCAVATOR CONTROL METHOD

CROSS-REFERENCE TO RELATED APPLICATIONS

This application claims priority to Japanese Patent Application No. 2010-113346 filed on May 17, 2010, and Japanese Patent Application No. 2010-259219 filed on Nov. 19, 2010, the entire disclosures of which are hereby incorporated herein by reference.

TECHNICAL FIELD

The present invention relates to a hydraulic excavator, and in particular to a hybrid hydraulic excavator having an electric motor that causes a revolving unit to swing, and to a hydraulic excavator control method.

BACKGROUND ART

In recent years, hybrid hydraulic excavators, particularly those such as described in International Patent Publication No. WO2007/052538, have been under development. A hybrid hydraulic excavator has an engine, a hydraulic pump, an electric motor, a work machine, and a revolving unit. The hydraulic pump is driven by the engine. The work machine is driven by hydraulic fluid discharged from the hydraulic pump. The electric motor is driven by electricity, and causes a revolving unit to swing.

SUMMARY

In a hybrid hydraulic excavator such as described above, kinetic energy is recovered and stored as electrical energy when the revolving unit is decelerated. The revolving unit is caused to swing by the driving of the electric motor using the stored energy. The fuel efficiency of the engine can thereby be improved. However, even in such hybrid hydraulic excavators, further improvement in fuel efficiency is desired. An object of the present invention lies in improving fuel efficiency in a hybrid hydraulic excavator.

A hydraulic excavator according to a first aspect of the present invention has a travel unit, a revolving unit, an engine, a hydraulic pump, a work machine, an electric accumulator, an electric power generating motor, an electric swing motor, a first operating device, a second operating device, and a control unit. The travel unit drives a vehicle. The revolving unit is mounted upon the travel unit, and is swingably provided to the travel unit. The hydraulic pump is driven by the engine. The work machine is driven by hydraulic fluid discharged from the hydraulic pump. The electric power generating motor generates power by being driven by the driving force from the engine, and stores electrical energy in the electric accumulator. The electric swing motor uses the electrical energy from the electric accumulator to swing the revolving unit. The electric swing motor swings the revolving unit at least with electrical energy from the electric accumulator, and may also at times be directly driven by electrical energy from the electric power generating motor. The first operating device is a device for operating the swinging the revolving unit. The second operating device is a device for operating the work machine. The control unit is configured to control the output of the engine on the basis of a first engine output torque line. The first engine output torque line defines the upper limit of engine output torque relative to engine rotation rate. The control unit is configured to determine which of a high hydraulic load operation in which the work machine is subject to a high hydraulic load and a low hydraulic load operation in which the work machine is subject to a low hydraulic load is being performed. When the operation for swinging the revolving unit and the low hydraulic load operation are being performed as a combined operation, the control unit is configured to control engine output on the basis of a second engine output torque line. The second engine output torque line is an engine output torque line having a lower engine output torque than the first engine output torque line.

A hydraulic excavator according to a second aspect of the present invention is the hydraulic excavator according to the first aspect, wherein the work machine has a boom, a bucket, and an arm. The low hydraulic load operation is an operation for lowering the boom.

A hydraulic excavator according to a third aspect of the present invention is the hydraulic excavator according to the first aspect, wherein the work machine has a boom, a bucket, and an arm. The low hydraulic load operation is an operation for dumping the bucket.

A hydraulic excavator according to a fourth aspect of the present invention is the hydraulic excavator according to the first aspect, wherein the work machine has a boom, a bucket, and an arm. The low hydraulic load operation is an operation for dumping the arm.

A hydraulic excavator according to a fifth aspect of the present invention is the hydraulic excavator according to any one of the first aspect through the fourth aspect, wherein, when the operation for swinging the revolving unit and the low hydraulic load operation are performed as a combined operation, engine rotation rate increases with engine torque in a lower state than when engine output is being controlled on the basis of the first engine output torque line.

A hydraulic excavator according to a sixth aspect of the present invention is the hydraulic excavator according to any one of the first aspect through the fourth aspect, wherein, when the operation for swinging the revolving unit and the low hydraulic load operation are performed as a combined operation, engine output torque increases within a lower range than when engine output is being controlled on the basis of the first engine output torque line.

A hydraulic excavator control method according to a seventh aspect of the present invention is a hydraulic excavator control method for a hydraulic excavator having a travel unit, a revolving unit, an engine, a hydraulic pump, a work machine, an electric accumulator, an electric power generating motor, an electric swing motor, a first operating device, and a second operating device. The travel unit drives a vehicle. The revolving unit is mounted upon the travel unit, and is swingably provided to the travel unit. The hydraulic pump is driven by the engine. The work machine is driven by hydraulic fluid discharged from the hydraulic pump. The electric power generating motor generates power by being driven by the driving force from the engine, and stores electrical energy in the electric accumulator. The electric swing motor uses the electrical energy from the electric accumulator to swing the revolving unit. The electric swing motor swings the revolving unit at least with electrical energy from the electric accumulator, and may also at times be directly driven by electrical energy from the electric power generating motor. The first operating device is a device for operating the rotating the revolving unit. The second operating device is a device for operating the work machine. In this hydraulic excavator control method, engine output is controlled on the basis of a first engine output torque line. A determination is made in regard to which of a high hydraulic load operation in which the work machine is subjected to a high hydraulic load and a low hydraulic load operation in which the work machine is subjected to a low hydraulic load is being performed. When the operation for rotating the revolving unit and the low hydraulic load operation are performed as a combined operation, engine output is controlled on the basis of a second engine output torque line. The first engine output torque line defines the upper limit of engine output torque relative to engine rotation rate. The second engine output torque line is an engine output torque line having a lower engine output torque than the first engine output torque line.

In the hydraulic excavator according to the first aspect of the present invention, when the operation for swinging the revolving unit and the low hydraulic load operation for the work machine are performed as a combined operation, engine output is controlled on the basis of the second engine output torque line. The second engine output torque line is an engine output torque line with a lower engine output torque than the first engine output torque line. In this hydraulic excavator, because the revolving unit is driven by the electric swing motor, during a combined operation in which swinging of the revolving unit and driving of the work machine are performed are performed, the hydraulic load is small compared to hydraulic excavators wherein a revolving unit is driven by a hydraulic motor. When the operation for swinging the revolving unit and the low hydraulic load operation are performed as a combined operation, the hydraulic load is small. In this state, by controlling the engine on the basis of the second engine output torque line, an increase in engine output torque can be prevented. For this reason, fuel efficiency can be improved as wasteful fuel injection is prevented.

In the hydraulic excavator according to the second aspect of the present invention, when the operation for swinging the revolving unit and the operation for lowering of the boom are performed as a combined operation, engine output is controlled on the basis of the second engine output torque line. When the boom is lowered, the hydraulic load is small compared to when excavation or other actions are being performed. For this reason, it is possible to improve fuel efficiency in this state by controlling the engine on the basis of the second engine output torque line.

In the hydraulic excavator according to the third aspect of the present invention, when the operation for swinging the revolving unit and the operation for dumping the bucket are performed as a combined operation, engine output is controlled on the basis of the second engine output torque line. Dumping the bucket is the operation of moving the end of the bucket downwards so that objects within the bucket are ejected from the bucket. Thus, when performing this operation, the hydraulic load is small compared to when excavation or other actions are being performed. For this reason, it is possible to improve fuel efficiency in this state by controlling the engine on the basis of the second engine output torque line.

In the hydraulic excavator according to the fourth aspect of the present invention, when the operation for swinging the revolving unit and the operation for dumping of the arm are performed as a combined operation, engine output is controlled on the basis of the second engine output torque line. Dumping the arm is the operation of moving the end of the arm upwards so that objects within the bucket are ejected from the bucket. Thus, when performing this operation, the hydraulic load is small compared to when excavation or other actions are being performed. Thus, it is possible to improve fuel efficiency in this state by controlling the engine on the basis of the second engine output torque line.

In the hydraulic excavator according to the fifth aspect of the present invention, when the operation for swinging the revolving unit and the low hydraulic load operation are performed as a combined operation, engine rotation rate increases. However, engine rotation rate increases with engine output torque in a lower state that when engine output is being controlled on the basis of the first engine output torque line. For this reason, fuel efficiency can be improved as wasteful fuel injection is prevented.

In the hydraulic excavator according to the sixth aspect of the present invention, when the operation for swinging the revolving unit and the low hydraulic load operation are performed as a combined operation, engine output torque increases. However, engine output torque increases within a lower range than when engine output is being controlled on the basis of the first engine output torque line. For this reason, fuel efficiency can be improved as wasteful fuel injection is prevented.

In the hydraulic excavator control method according to the seventh aspect of the present invention, when the operation for swinging the revolving unit and the low hydraulic load operation for the work machine are being performed as a combined operation, engine output is controlled on the basis of the second engine output torque line. The second engine output torque line is an engine output torque line with a lower engine output torque than the first engine output torque line. In this hydraulic excavator, because the revolving unit is driven by the electric swing motor, during a combined operation in which swinging of the revolving unit and driving of the work machine are performed, the hydraulic load is small compared to hydraulic excavators wherein the revolving unit is driven by a hydraulic motor. When the operation for swinging the revolving unit and the low hydraulic load operation are being performed as a combined operation, the hydraulic load is small. In this state, by controlling the engine on the basis of the second engine output torque line, an increase in engine output torque can be prevented. For this reason, fuel efficiency can be improved as wasteful fuel injection is prevented.

DETAILED DESCRIPTION OF THE PREFERRED EMBODIMENTS

Figure 1:
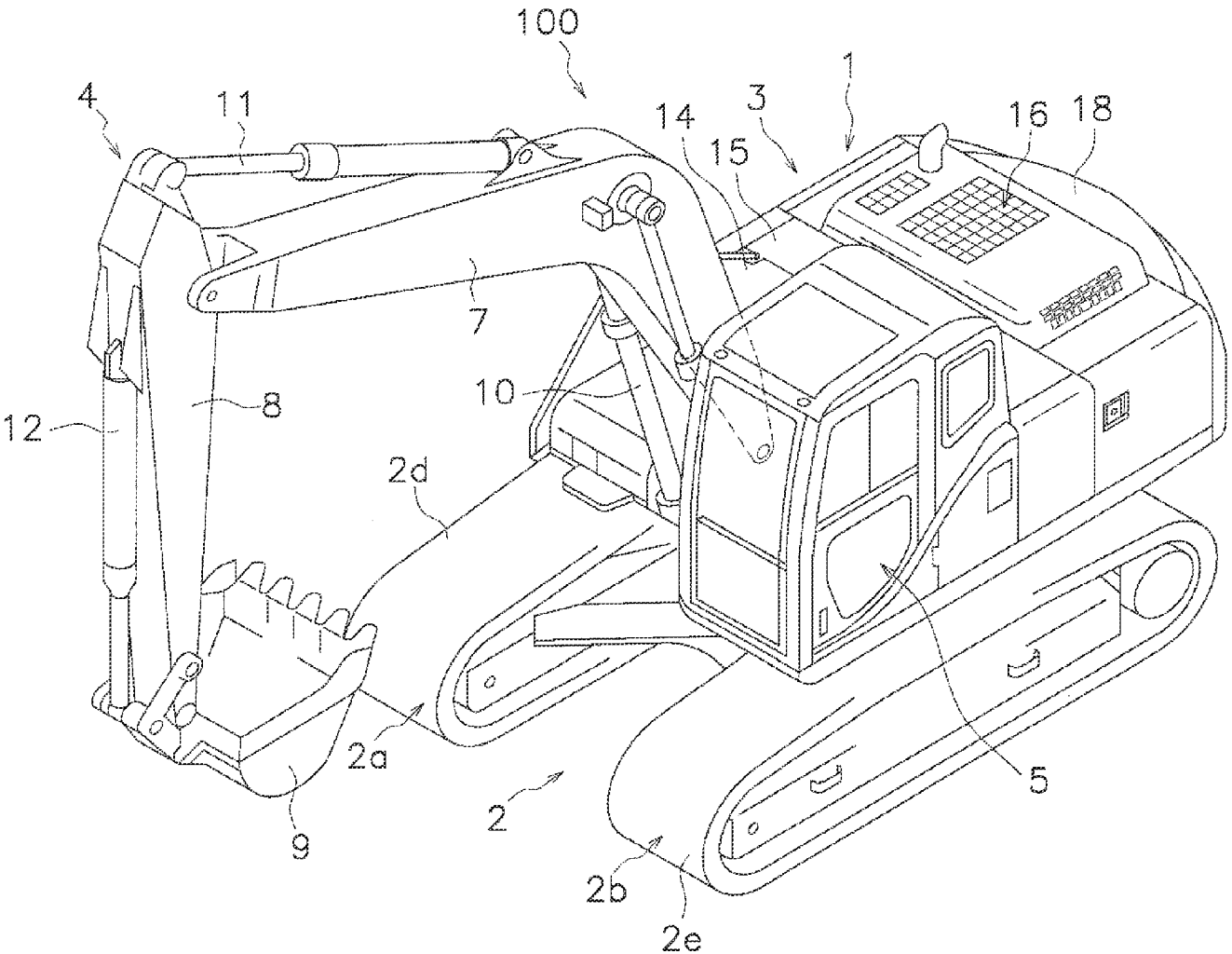
FIG. 1 is a perspective illustration of a hydraulic excavator according to an embodiment of the present invention.

FIG. 1 depicts a hydraulic excavator 100 according to an embodiment of the present invention. This hydraulic excavator 100 has a main vehicle body 1 and a work machine 4.

The main vehicle body 1 has a travel unit 2 and a revolving unit 3. The travel unit 2 has a pair of drive devices 2*a* and 2*b*. The drive devices 2*a* and 2*b* each have a track 2*d* and 2*e*. The drive devices 2*a* and 2*b* move the hydraulic excavator 100 by driving the tracks 2*d* and 2*e* with a right track motor 35 and a left track motor 36 described below (see FIG. 2).

The revolving unit 3 is mounted upon the travel unit 2. The revolving unit 3 can swing with respect to the travel unit 2, and swings by being driven by an electric swing motor 32 described below (see FIG. 2). The revolving unit 3 is also provided with a cab 5. The revolving unit 3 has a fuel tank 14, a hydraulic fluid tank 15, an engine compartment 16, and a counterweight 18. The fuel tank 14 stores fuel for driving an engine 21 described below (see FIG. 2). The hydraulic fluid tank 15 stores hydraulic fluid discharged from a hydraulic pump 25 described below (see FIG. 2). The engine compartment 16 encloses machinery such as the engine 21 and the hydraulic pump 25 as described below. The counterweight 18 is disposed rearward of the engine compartment 16.

The work machine 4 is attached to a central position of the front of the revolving unit 3, and has a boom 7, an arm 8, a bucket 9, a boom cylinder 10, an arm cylinder 11, and a bucket cylinder 12. A base end of the boom 7 is rotatably connected to the revolving unit 3. A tip of the boom 7 is rotatably connected to a base end of the arm 8. A tip of the arm 8 is rotatably connected to the bucket 9. The boom cylinder 10, arm cylinder 11, and bucket cylinder 12 are hydraulic cylinders driven by hydraulic fluid discharged from the hydraulic pump 25 described below. The boom cylinder 10 actuates the boom 7. The arm cylinder 11 actuates the arm 8. The bucket cylinder 12 actuates the bucket 9. Driving these cylinders 10, 11, and 12 drives the work machine 4.

Figure 2:
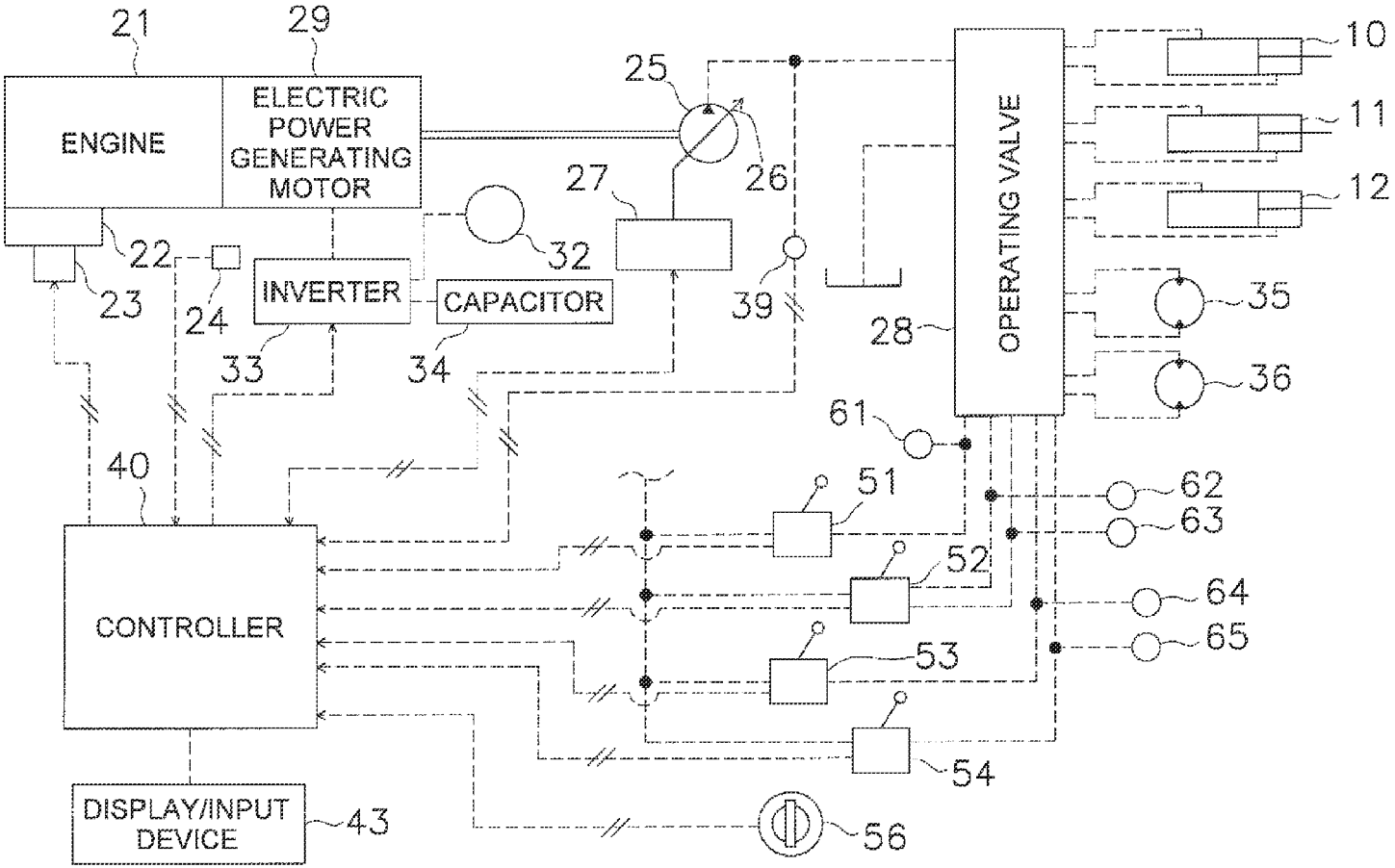
FIG. 2 is a block diagram illustrating the structure of a control system of a hydraulic excavator.

FIG. 2 illustrates the structure of a control system of the hydraulic excavator 100. The engine 21 is a diesel engine, and the output horsepower thereof is controlled by adjusting the amount of fuel injected into the cylinders. Such adjustment is performed by controlling an electronic governor 23 attached to a fuel injector pump 22 of the engine 21 via a command signal from a controller 40. A all-speed governor is typically used as the governor 23, which adjusts the engine rotation rate and fuel injection amount according to load so that engine rotation rate becomes a target rotation rate described below. Specifically, the governor 23 increases or decreases the fuel injection amount so that deviation between target rotation rate and actual engine rotation rate is eliminated. The actual rotation rate of the engine 21 is detected by a rotational sensor 24. The actual rotation rate of the engine 21 detected by the rotational sensor 24 is input as a detection signal to a controller 40 described below.

An output shaft of the engine 21 is linked to a drive shaft of the hydraulic pump 25. The hydraulic pump 25 is driven by the rotation of the output shaft of the engine 21. The hydraulic pump 25 is a variable displacement hydraulic pump whose displacement is varied by changes in the tilt angle of a swash plate 26.

A pump control valve 27 is operated by a command signal input from a controller 40, and controls the hydraulic pump 25 via a servo piston. The pump control valve 27 controls the tilt angle of the swash plate 26 so that the product of the discharge pressure of the hydraulic pump 25 and the displacement of the hydraulic pump 25 does not surpass a pump absorption torque corresponding to a command value (command current value) of the command signal input to the pump control valve 27 from the controller 40. Specifically, the pump control valve 27 controls the absorption torque of the hydraulic pump 25 according to the input command current value.

The hydraulic fluid discharged from the hydraulic pump 25 is supplied to various hydraulic actuators via an operating valve 28. Specifically, hydraulic fluid is supplied to the boom cylinder 10, the arm cylinder 11, the bucket cylinder 12, the right track motor 35, and the left track motor 36. The boom cylinder 10, arm cylinder 11, bucket cylinder 12, right track motor 35, and left track motor 36 are thereby driven, operating the boom 7, arm 8, bucket 9, and tracks 2*d* and 2*e* of the travel unit 2. The discharge pressure of the hydraulic pump 25 is detected by a hydraulic pressure sensor 39, and input to the controller 40 as a detection signal.

The operating valve 28 is a valve for controlling flow rate and direction of the hydraulic fluid. The operating valve 28 includes a plurality of control valves corresponding to the hydraulic actuators 10 to 12, 35, and 36. The operating valve 28 supplies the hydraulic fluid to the corresponding hydraulic actuators 10 to 12, 35, and 36 according to the direction of operation of operating devices 51 to 54 described below. The operating valve 28 moves a spool so that a fluid path opens with an opening area corresponding to the operation amount of the operating devices 51 to 54.

The output shaft of the engine 21 is linked to a drive shaft of an electric power generating motor 29. The electric power generating motor 29 performs power generation and motor functions. The electric power generating motor 29 is connected to the electric swing motor 32 and a capacitor 34 serving as an electric accumulator via an inverter 33. Electrical energy is stored in the capacitor 34 through power generation performed by the electric power generating motor 29. The capacitor 34 supplies electrical energy to the electric swing motor 32. When the electric power generating motor 29 performs motor functions, the capacitor 34 supplies electrical energy to the electric power generating motor 29. The electric swing motor 32 is driven by electrical power supplied by the capacitor 34, and swings the above revolving unit 3.

The torque of the electric power generating motor 29 is controlled by the controller 40. When the electric power generating motor 29 is controlled so as to perform power generation, part of the output torque generated by the engine 21 is conveyed to the drive shaft of the electric power generating motor 29, the torque from the engine 21 is absorbed, and power generation is performed. Alternating current electrical energy generated by the electric power generating motor 29 is converted to direct current electrical energy by the inverter 33 and supplied to the capacitor 34. When the electric power generating motor 29 is controlled so as to perform motor functions, the direct current electrical energy stored in the capacitor 34 is converted to alternating current electrical energy by the inverter 33 and supplied to the electric power generating motor 29. The drive shaft of the electric power generating motor 29 is thereby driven to rotate, and torque is generated in the electric power generating motor 29. This torque is conveyed from the drive shaft of the electric power generating motor 29 to the output shaft of the engine 21 and added to the output torque of the engine 21. The power generation amount (absorption torque amount) and motor function amount (assistance amount; torque generation amount) of the electric power generating motor 29 are controlled in response to the command signal from the controller 40.

The inverter 33 converts the power generated when the electric power generating motor 29 performs power generation or the power stored in the capacitor 34 to the desired voltage, frequency, and phase called for by the electric swing motor 32 and supplies it to the electric swing motor 32. When the swinging of the revolving unit 3 is decelerated or arrested, the kinetic energy of the revolving unit 3 is converted to electrical energy. This electrical energy is either stored in the capacitor 34 as regenerated power or supplied as power for the motor functions of the electric power generating motor 29.

The cab 5 is provided with various operating devices 51 to 56 and a display/input device 43. The operating devices 51 to 56 include a first work operating device 51, a second work operating device 52, a first drive operating device 53, a second drive operating device 54, and a target rotation rate setting device 56.

The first work operating device 51 has an operating member such as a lever manipulated by an operator to actuate the arm 8 and revolving unit 3. The first work operating device 51 actuates the arm 8 or the revolving unit 3 according to the direction of manipulation. The first work operating device 51 also actuates the arm 8 or the revolving unit 3 at a speed corresponding to the amount of manipulation. An operation signal indicating the direction and amount of manipulation of the first work operating device 51 is inputted to the controller 40. When the first work operating device 51 is manipulated in a direction so as to actuate the arm 8, an arm operation signal indicating arm excavation operation amount or arm dumping operation amount is inputted to the controller 40 according to the direction and amount the first work operating device 51 is manipulated relative to a neutral position. Arm excavation operation refers to the operation of moving the tip of the arm 8 downwards. Arm dumping operation refers to the operation of moving the tip of the arm 8 upwards. When the first work operating device 51 is manipulated in a direction so as to actuate the revolving unit 3, a swinging operation signal indicating rightward swinging or leftward swinging is inputted to the controller 40 according to the direction and amount the first work operating device 51 is manipulated relative to a neutral position.

When the first work operating device 51 is manipulated in a direction so as to actuate the arm 8, pilot pressure (PPC pressure) corresponding to the amount the first work operating device 51 is manipulated is supplied to a pilot port of the operating valve 28 corresponding to manipulation direction (arm excavation direction or arm dumping direction). The pilot pressure from the first work operating device 51 is detected by a hydraulic pressure sensor 61, and is sent to the controller 40 as a detection signal.

The second work operating device 52 has an operating member such as a lever manipulated by an operator to actuate the boom 7 or the bucket 9. The second work operating device 52 actuates the boom 7 or bucket 9 according to the direction of manipulation. The second work operating device 52 also actuates the boom 7 or the bucket 9 at a speed corresponding to the amount of manipulation. When the second work operating device 52 is manipulated in a direction so as to actuate the boom 7, a boom operation signal indicating boom raising operation amount or boom lowering operation amount is inputted to the controller 40 according to the direction and amount the second work operating device 52 is manipulated relative to a neutral position. Boom raising operation refers to the operation of moving the tip of the boom 7 upwards. Boom lowering operation refers to the operation of moving the tip of the boom 7 downwards. When the second work operating device 52 is manipulated in a direction so as to actuate the bucket 9, a bucket operation signal indicating bucket excavation operation amount or bucket dumping operation amount is inputted to the controller 40 according to the direction and amount the second work operating device 52 is manipulated relative to a neutral position. Bucket excavation operation refers to the operation of moving the tip of the bucket 9 downwards. Bucket dumping operation refers to the operation of moving the tip of the bucket 9 upwards.

When the second work operating device 52 is manipulated in a direction so as to actuate the boom 7, pilot pressure (PPC pressure) corresponding to the amount the second work operating device 52 is manipulated is supplied to a pilot port of the operating valve 28 corresponding to manipulation direction (boom raising or boom lowering). When the second work operating device 52 is manipulated in a direction so as to actuate the bucket 9, pilot pressure (PPC pressure) corresponding to the amount the second work operating device 52 is manipulated is supplied to a pilot port of the operating valve 28 corresponding to manipulation direction (bucket excavation direction or bucket dumping direction). The pilot pressure for actuating the boom 7 from the second work operating device 52 is detected by a hydraulic pressure sensor 62, and is sent to the controller 40 as a detection signal. The pilot pressure for actuating the bucket 9 from the second work operating device 52 is detected by a hydraulic pressure sensor 63, and is sent to the controller 40 as a detection signal.

Each of the first drive operating device 53 and second drive operating device 54 has an operating member such as a lever manipulated by an operator in order to drive the tracks 2*d* and 2*e*. The first drive operating device 53 and second drive operating device 54 drive the tracks 2*d* and 2*e* according to the direction of manipulation, and drive the tracks 2*d* and 2*e* at a speed corresponding to the amount of manipulation. As with the first work operating device 51 and second work operating device 52, pilot pressure (PPC pressure) according to the amount the first drive operating device 53 and second drive operating device 54 are manipulated is supplied to a pilot port of the operating valve 28 corresponding to the direction of manipulation. This pilot pressure (PPC pressure) is detected by hydraulic pressure sensors 64 and 65, and input to the controller 40 as a detection signal.

The target rotation rate setting device 56 is a device for setting target rotation rate of the engine 21 as described below. The target rotation rate setting device 56 has an operating member such as, for example, a dial. By manipulating the target rotation rate setting device 56, an operator can manually set the target rotation rate of the engine 21. The specifics of the manipulation of the target rotation rate setting device 56 are sent to the controller 40 as an operation signal.

The display/input device 43 functions as a display device for displaying various data for the hydraulic excavator 100 such as engine rotation rate and hydraulic fluid temperature. The display/input device 43 also has a touchscreen monitor and functions as an input device manipulated by the operator.

Figure 3:
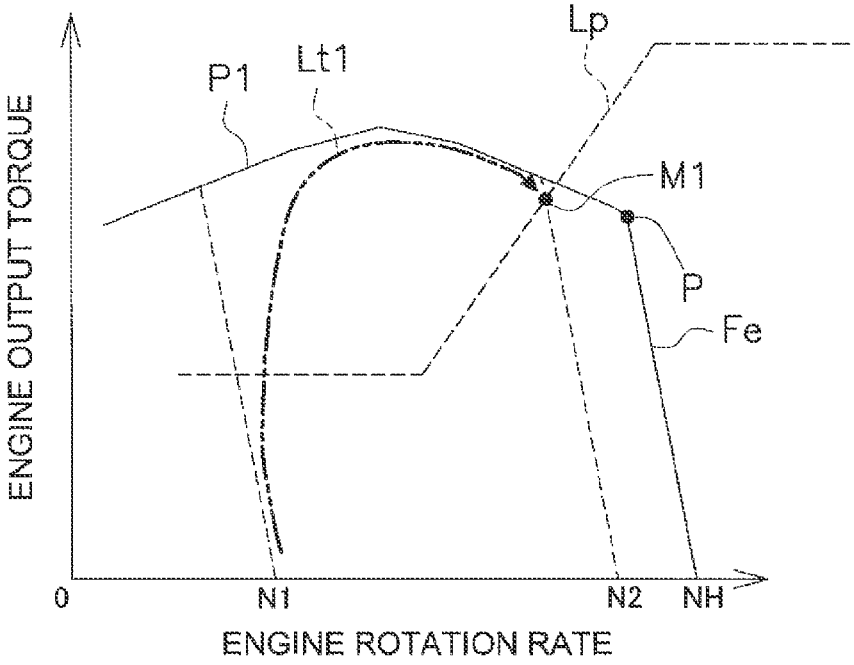
FIG. 3 is an illustration of an engine output torque line and a hydraulic pump absorption torque line.

The controller 40 is constituted by a computer having memory such as RAM and ROM and devices such as a CPU. The controller 40 controls the engine 21 on the basis of an engine output torque line such as illustrated by P1 in FIG. 3. The engine output torque line represents the upper limit value for torque output against the rotation rate of the engine 21. Specifically, the engine output torque line defines the relationship between engine rotation rate and the maximum output torque value for the engine 21. The governor 23 controls the output of the engine 21 so that the output torque of the engine 21 does not surpass the engine output torque line. The engine output torque line is stored in a memory device (not shown). The controller 40 changes the engine output torque line in response to the target rotation rate setting. The controller 40 sends a command signal to the governor 23 so that engine rotation rate becomes the set target rotation rate. Fe in FIG. 3 illustrates a maximum speed regulation line connecting a rating point P illustrating when target rotation rate is the maximum target rotation rate and a high-idling point NH. The first engine output torque line P1 illustrated in FIG. 3 is equivalent to, for example, a rating or maximum power output of the engine 21.

The controller 40 calculates a target absorption torque for the hydraulic pump 25 according to the target rotation rate of the engine 21. The target absorption torque is set so that the output horsepower of the engine 21 and the absorbed horsepower of the hydraulic pump 25 are in balance. The controller 40 calculates target absorption torque on the basis of a pump absorption torque line such as that illustrated by Lp in FIG. 3. The pump absorption torque line defines the relationship between engine rotation rate and the absorption torque of the hydraulic pump 25, and is stored in the memory device.

The controller 40 automatically changes the rotation rate of the engine 21 according to the operation amounts of the operating devices 51 to 54 and the hydraulic load. For instance, when excavation is performed when the target rotation rate of the engine is set to N1 as illustrated in FIG. 3, the target rotation rate of the engine is changed from N1 to N2. A command signal is thereby sent from the controller 40 to the governor to increase the engine rotation rate. As a result, engine rotation rate and engine output torque increase along a locus Lt1 towards a matching point M1.

Figure 4:
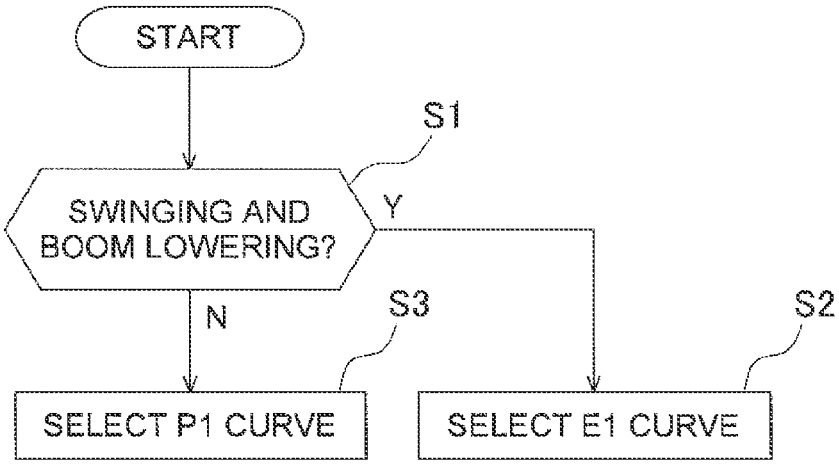
FIG. 4 is an illustration of a method of selecting an engine output torque line.
Figure 5:
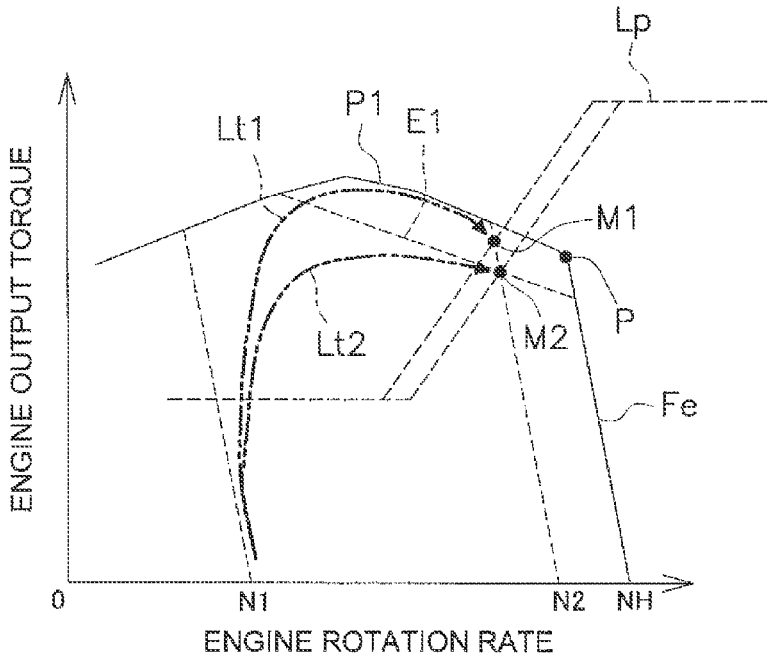
FIG. 5 is an illustration of changes in engine output torque and engine rotation rate.

The controller 40 also changes the engine output torque line in response to the operation of the operating devices 51 to 54. Specifically, when operation for swinging the revolving unit 3 and operation for the work machine 4 are performed as a combined operation, a procedure such as that in FIG. 4 is followed. First, in step S1, it is determined whether operation for swinging the revolving unit 3 and operation for lowering the boom 7 (hereafter "swinging and boom lowering" operation) are being performed as a combined operation. If "swinging and boom lowering" operation is being performed, in step S2, the second engine output torque line E1 (curve E1) is selected. As illustrated in FIG. 5, the second engine output torque line E1 is an engine output torque line with a lower engine output torque than the first engine output torque line P1 described above. Specifically, within a predetermined engine rotation rate range greater than low idling rotation rate, the engine output torque of the second engine output torque line E1 is lower than the engine output torque of the first engine output torque line P1.

As illustrated in FIG. 4, when combined operations other than those described above are performed, in step S3, the first engine output torque line P1 (curve p1) is selected. For example, when excavation as described above or another operation creating a large hydraulic load (hereafter "high hydraulic load operation") and operation for swinging the revolving unit 3 are performed as a combined operation, the first engine output torque line P1 is selected. On the basis of the intensity of the pilot pressure from the operating devices 51 to 54, the controller 40 determines whether or not the high hydraulic load operation is being performed, and whether or not a low hydraulic load operation is being performed. Here, the low hydraulic load operation and the high hydraulic load operation refer to the anticipated size of the hydraulic load sustained when the work machine 4 is working and loaded with gravel or other material being worked with. The low hydraulic load operation and the high hydraulic load operation do not necessarily refer to the size of the hydraulic load sustained when the work machine 4 is not loaded with gravel or other material being worked with.

In this hydraulic excavator 100, when "swinging and boom lowering" operation is performed and the target rotation rate of the engine increases from N1 to N2, a command signal is sent from the controller 40 to the governor to increase engine rotation rate and engine output torque, as described above. As illustrated in FIG. 5, the second engine output torque line E1 is chosen as the engine output torque line. For this reason, engine rotation rate and engine output torque increase along a locus Lt2 towards a matching point M2. As is clear from FIG. 5, on the locus Lt2, engine rotation rate increases with engine output torque in a lower state than in locus Lt1 described above. At the matching point M2, engine output torque is also lower than at matching point M1. Thus, on the locus Lt2, engine output torque increases in a lower range than in locus Lt1 described above. When dumping operation of the bucket 9 is being performed alone, the second engine output torque line E1 is, as above, likewise selected as the engine output torque line. Engine rotation rate thereby increases with engine output torque in a low state.

As described above, in this hydraulic excavator 100, when an operation such as those described above incurring a low hydraulic load (hereafter "low hydraulic load operation") and operation for swinging the revolving unit 3 are performed as a combined operation, engine output is controlled so that engine output torque has a lower upper limit than with other combined operation, namely a combined operation of the high hydraulic load operation and operation for swinging the revolving unit 3. It is thereby possible to prevent wasteful fuel injection and improve the fuel efficiency of the engine 21.

An embodiment of the present invention was described above, but the present invention is not limited thereto; various modifications can be made without departing from the scope of the invention.

The controller 40 may be constituted by a plurality of computers. The electric accumulator is not limited to a capacity, but may be another device such as a battery.

The determination of whether or not a low hydraulic load operation is being performed need not be on the basis of the pilot pressure from the operating devices 51 to 54, but may be on the basis of other parameters as well. For example, the determination of whether operation for swinging is being performed may be made on the basis of a detection signal from a swinging sensor that senses swinging movement of the revolving unit 3.

Figure 6:
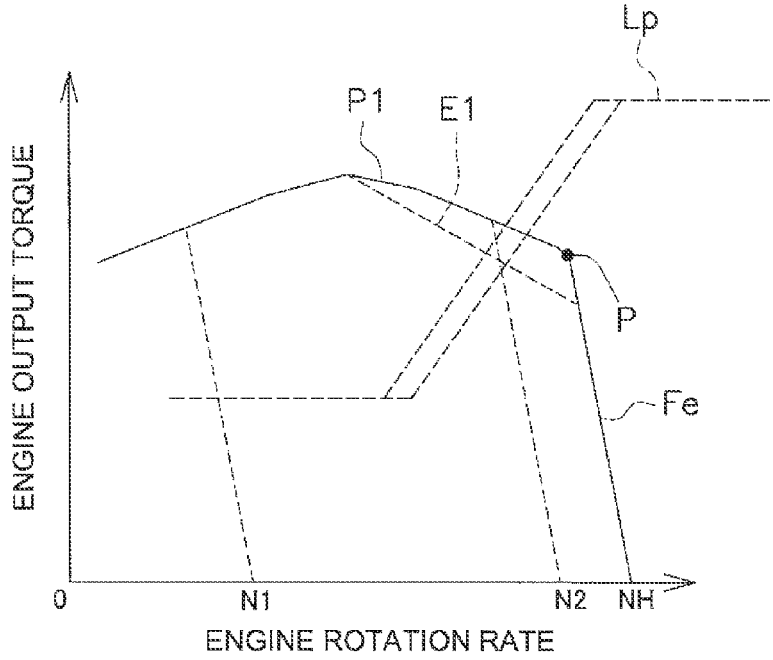
FIG. 6 is an illustration of a second engine output torque line according to another embodiment.

The second engine output torque line is not limited to the second engine output torque line E1 as illustrated in FIG. 5. For example, a second engine output torque line E1 such as that shown in FIG. 6 may be used. This second engine output torque line E1 is set so that there is a small difference in torque when engine rotation rate is low and a large difference in torque when engine rotation rate is high. The difference in torque is the difference between a first engine output torque and a second engine output torque. Specifically, in this second engine output torque line E1, when engine rotation rate is low, there is little decrease in engine output torque for the first engine output torque. When engine rotation rate is high, the amount of decrease in engine output torque for the first engine output torque increases.

The operation for the work machine 4 may be divided into low hydraulic load operation and high hydraulic load operation according to the direction of operation. For example, boom lowering operation may be a low hydraulic load operation, and boom raising operation may be a high hydraulic load operation. Likewise, dumping operation for the bucket 9 may be a low hydraulic load operation, and excavating operation for the bucket 9 may be a high hydraulic load operation. Furthermore, dumping operation for the arm 8 may be a low hydraulic load operation, and excavation operation for the arm 8 may be a high hydraulic load operation.

Figure 7:
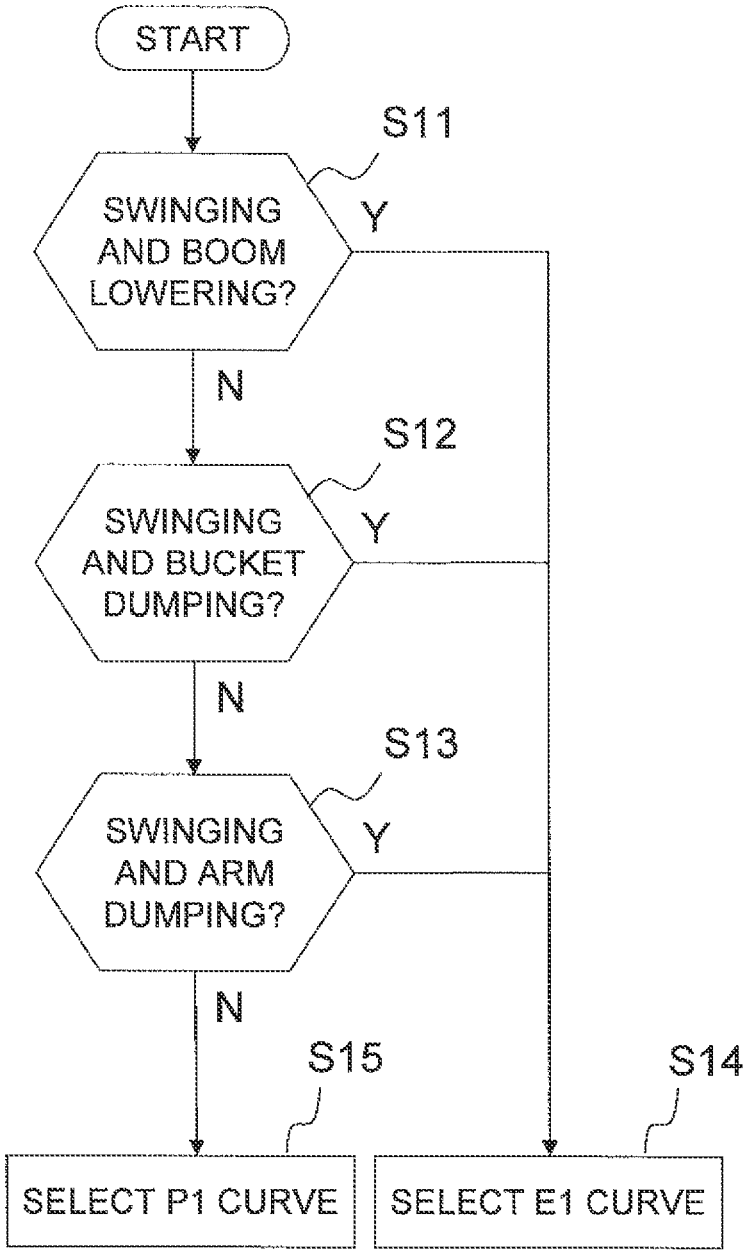
FIG. 7 is an illustration of a method of selecting an engine output torque line according to another embodiment of the present invention.

Thus, when combined operations are performed, an engine output torque line selection procedure may be performed as illustrated in the flow chart of FIG. 7. Specifically, in step S11, it is determined whether or not "swinging and boom lowering" operation is being performed. If "swinging and boom lowering" operation is being performed, in step S14, the second engine output torque line E1 (curve E1) is selected. As described above, the second engine output torque line E1 is an engine output torque line with a lower engine output torque than the first engine output torque line P1 (see FIG. 5). Specifically, within a predetermined engine rotation rate range greater than a low idling rotation rate, the engine output torque of the second engine output torque line E1 is lower than the engine output torque of the first engine output torque line P1. When "swinging and boom lowering" operation is not being performed, the procedure continues to step S12. In step S12, it is determined whether or not operation for swinging the revolving unit 3 and bucket dumping operation are being performed as a combined operation (hereafter "swinging and bucket dumping" operation). When "swinging and bucket dumping" operation is being performed, in step S14, the second engine output torque line E1 (curve E1) is selected. When "swinging and bucket dumping" operation is not being performed, the procedure continues to step S13. In step S13, it is determined whether or not operation for swinging the revolving unit 3 and arm dumping operation are being performed as a combined operation (hereafter "swinging and arm dumping" operation). When "swinging and arm dumping" operation is being performed, in step S14, the second engine output torque line E1 (curve E1) is selected. When "swinging and arm dumping" operation is not being performed, the procedure continues to step S15. In step S15, the first engine output torque line P1 (curve p1) is selected. Specifically, when a combined operation other than "swinging and boom lowering" operation, "swinging and bucket dumping" operation, or "swinging and arm dumping" operation is performed, the first engine output torque line P1 is chosen.

In the present invention, it is possible to improve fuel efficiency in a hybrid hydraulic excavator.

The invention claimed is:

1. A hydraulic excavator comprising:

a travel unit configured to drive a vehicle;

a revolving unit mounted upon the travel unit and swingably provided to the travel unit;

an engine;

a hydraulic pump driven by the engine;

a work machine driven by hydraulic fluid discharged by the hydraulic pump;

an electric accumulator;

an electric power generating motor driven by driving force from the engine, whereby a power-generating action is performed, the electric power generating motor being configured to store electrical energy in the electric accumulator;

an electric swing motor configured to swing the revolving unit using the electrical energy from the electric accumulator;

a first operating device configured to operate the swinging of the revolving unit;

a second operating device configured to operate the work machine; and a control unit configured to control output of the engine on the basis of a first engine output torque line that defines an upper limit of engine output torque relative to engine rotation rate, the control unit being configured to determine which of a high hydraulic load operation in which the work machine is subjected to a high hydraulic load and a low hydraulic load operation in which the work machine is subjected to a low hydraulic load is being performed, and the control unit being configured to control the output of the engine on the basis of a second engine output torque line having lower engine output torque than the first engine output torque line when the operation for swinging the revolving unit and the low hydraulic load operation are performed as a combined operation.

2. The hydraulic excavator according to claim 1, wherein the work machine has a boom, a bucket, and an arm, and the low hydraulic load operation is an operation for lowering the boom.

3. The hydraulic excavator according to claim 1, wherein the work machine has a boom, a bucket, and an arm, and the low hydraulic load operation is an operation for dumping the bucket.

4. The hydraulic excavator according to claim 1, wherein the work machine has a boom, a bucket, and an arm, and the low hydraulic load operation is an operation for dumping the arm.

5. The hydraulic excavator according to claim 1, wherein when the operation for swinging the revolving unit and the low hydraulic load operation are performed as a combined operation, engine rotation rate increases with engine output torque in a lower state than when engine output is controlled on the basis of the first engine output torque line.

6. The hydraulic excavator according to claim 1, wherein when the operation for swinging the revolving unit and the low hydraulic load operation are performed as a combined operation, engine output torque increases within a lower range than when engine output is being controlled on the basis of the first engine output torque line.

7. A hydraulic excavator control method for a hydraulic excavator including a travel unit for driving a vehicle, a revolving unit mounted on the travel unit and swingably provided to the travel unit, an engine, a hydraulic pump driven by the engine, a work machine driven by hydraulic fluid discharged from the hydraulic pump, an electric accumulator, an electric power generating motor driven by driving force from the engine, to perform a power-generating action and configured to store electrical energy in the electric accumulator, an electric swing motor for swinging the revolving unit using the electrical energy from the electric accumulator, a first operating device for operating the swinging of the revolving unit, and a second operating device for operating the work machine, the hydraulic excavator control method comprising:

controlling output of the engine on the basis of a first engine output torque line that defines an upper limit of engine output torque relative to engine rotation rate;

determining which of a high hydraulic load operation in which the work machine is subjected to a high hydraulic load and a low hydraulic load operation in which the work machine is subjected to a low hydraulic load is being performed; and controlling the output of the engine on the basis of a second engine output torque line having lower engine output torque than the first engine output torque line when the operation for swinging the revolving unit and a low hydraulic load operation are performed as a combined operation.

* * * * *